United States Patent [19]

Teichert

[11] 4,129,847

[45] Dec. 12, 1978

[54] CUT-BACK THERMOSTAT CONSTRUCTION

[75] Inventor: Allen L. Teichert, Placentia, Calif.

[73] Assignee: Robertshaw Controls Company, Richmond, Va.

[21] Appl. No.: 803,978

[22] Filed: Jun. 6, 1977

[51] Int. Cl.[2] ..... H01H 37/62

[52] U.S. Cl. ..... 337/301; 337/305

[58] Field of Search ..... 337/301, 302, 303, 304, 337/305

[56] References Cited

U.S. PATENT DOCUMENTS

| | | | |
|---|---|---|---|
| 2,262,962 | 11/1941 | Pierson | 337/301 X |
| 3,036,470 | 5/1962 | Houser et al. | 337/301 X |
| 3,825,872 | 7/1974 | Sadler et al. | 337/301 |

*Primary Examiner*—George Harris

*Attorney, Agent, or Firm*—Candor, Candor & Tassone

[57] ABSTRACT

A cut-back thermostat construction having a thermostat arrangement and a timer carried by a housing in such a manner that the timer will cut back the temperature setting of the thermostat arrangement by moving an electrical switch of the thermostat arrangement relative to a temperature responsive switch operator of the thermostat arrangement when a predetermined time is reached by the timer. A movable actuator is operatively associated with the switch to be adapted to cause a certain movement of the switch relative to the switch operator when the actuator is moved from a first position thereof to a second position thereof by the timer when the predetermined time is reached. An adjustable member is separate from the actuator and is adapted to select the amount of movement of the switch relative to the switch operator when the actuator is moved from the first position thereof to the second position thereof whereby the adjustable member selects the cut-back temperature of the thermostat arrangement. A pair of spaced stops are carried inside the housing for limiting the degree of adjustment of the adjustable member and, thus, the amount of movement of the switch relative to the switch operator. The timer comprises a rotatable time indicating dial carrying an adjustable tab to be set at different positions therewith for selecting the predetermined time for adjusting the thermostat arrangement, the adjustable tab being snap-fitted to the dial.

20 Claims, 7 Drawing Figures

CUT-BACK THERMOSTAT CONSTRUCTION

This invention relates to an improved cut-back thermostat construction and timer dial means therefor or the like.

It is well known that cut-back thermostat constructions have been provided wherein each has a timer means for causing the thermostat unit thereof to be automatically turned back to a lower temperature when the timer reaches a preselected time. For example, such a cut-back thermostat construction can be set to cut-back the thermostat setting thereof from its normal high temperature day-time setting to a low temperature night-time setting when the timer reaches a selected time period. Such thermostat construction can also then automatically reset the thermostat setting back to the day-time setting thereof when the timer subsequently reaches another predetermined time period thereof, such as in the morning. In this manner, a savings in energy use and cost will automatically result.

For example, see the co-pending patent application, Ser. No. 644,611, filed Dec. 29, 1975, of Werner R. Bauer for such a cut-back thermostat construction.

One embodiment of the invention in the aforementioned co-pending patent application provides a cut-back thermostat construction having a thermostat arrangement and a timer means carried by a frame means in such a manner that the timer means will cut-back the temperature setting of the thermostat arrangement by moving an electrical switch means of the thermostat arrangement relative to a temperature responsive switch operator of the thermostat arrangement when a predetermined time is reached by the timer means, a movable actuator means being carried by the frame means and being operatively associated with the switch means to be adapted to cause a certain movement of the switch relative to the switch operator when the actuator means is moved from a first position thereof to a second position thereof by the timer means when the predetermined time is reached by the timer means.

The cut-back thermostat construction of the co-pending patent application Ser. No. 644,599, filed Dec. 29, 1975, of Edgar E. Marquis et al is an improvement of the aforementioned cut-back thermostat construction of Ser. No. 644,611 as the same provides an adjustable member carried by the frame means and being separate from the actuator means for selecting the amount of movement of the switch means relative to the switch operator when the actuator means is moved from the first position thereof to the second position thereof whereby the adjustable member selects the cut-back temperature of the thermostat arrangement independently of the actuator means.

It is a feature of this invention to provide improvements in the cut-back thermostat construction of the aforementioned co-pending patent application Ser. No. 644,599.

In particular, one embodiment of this invention provides improved stop means for limiting the degree of adjustment of the adjustable member and, thus, the amount of movement of the switch means relative to the switch operator.

For example, the cut-back thermostat construction of the aforementioned co-pending patent application Ser. No. 644,599 limited the movement of the adjustable member by the length of the slot formed in the housing of the cut-back thermostat and through which the lever arm of the adjustable member extended.

In contrast, the stop means of this invention are disposed internally in the housing means and cooperate with a tongue extension of the adjustable member to limit the movement thereof relative to the switch means as will be apparent hereinafter.

It is another feature of this invention to provide an improved timer dial of the cut-back thermostat construction of the aforementioned co-pending patent application Ser. No. 644,599, as well as of the cut-back thermostat construction of the aforementioned co-pending patent application Ser. No. 644,611.

In particular, the cut-back thermostat constructions of the two aforementioned co-pending patent applications each including a timer dial and at least one adjustable tab to be set in different positions relative to the timer dial for selecting a desired predetermined time for adjusting the thermostat arrangement of the cut-back thermostat. Such adjustable tab is either secured for rotatable movement on a hub of the timer dial itself or on a hub of the housing means that receives the timer dial.

In contrast, the adjustable tabs of this invention are each snap-fitted to the hub of the timer dial to be carried thereby and be easily assembled thereto as will be apparent hereinafter.

Accordingly, it is an object of this invention to provide an improved cut-back thermostat construction having one or more of the novel features of this invention as set forth above or hereinafter shown or described.

Another object of this invention is to provide an improved part for such a cut-back thermostat construction or the like, the improved part of this invention having one or more of the novel features of this invention as set forth above or hereinafter shown or described.

Other objects, uses and advantages of this invention are apparent from a reading of this description which proceeds with reference to the accompanying drawings forming a part thereof and wherein.

Figure 1:
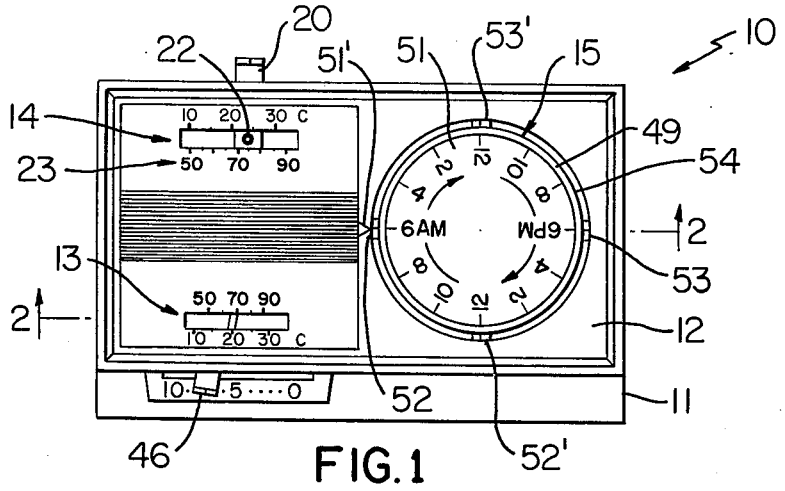
FIG. 1 is a front view of the improved cut-back thermostat construction of this invention.

While the various features of this invention are hereinafter described and illustrated as being particularly adapted to provide the cut-back thermostat construction for operating a heat exchange unit for a building or residence, it is to be understood that the various features of this invention can be utilized singly or in any combination thereof to provide a cut-back thermostat construction for other apparatus as desired as well as to provide parts for other types of thermostat construction.

Therefore, this invention is not to be limited to only the embodiment illustrated in the drawings, because the drawings are merely utilized to illustrate one of the wide variety of uses of this invention.

Figure 2:
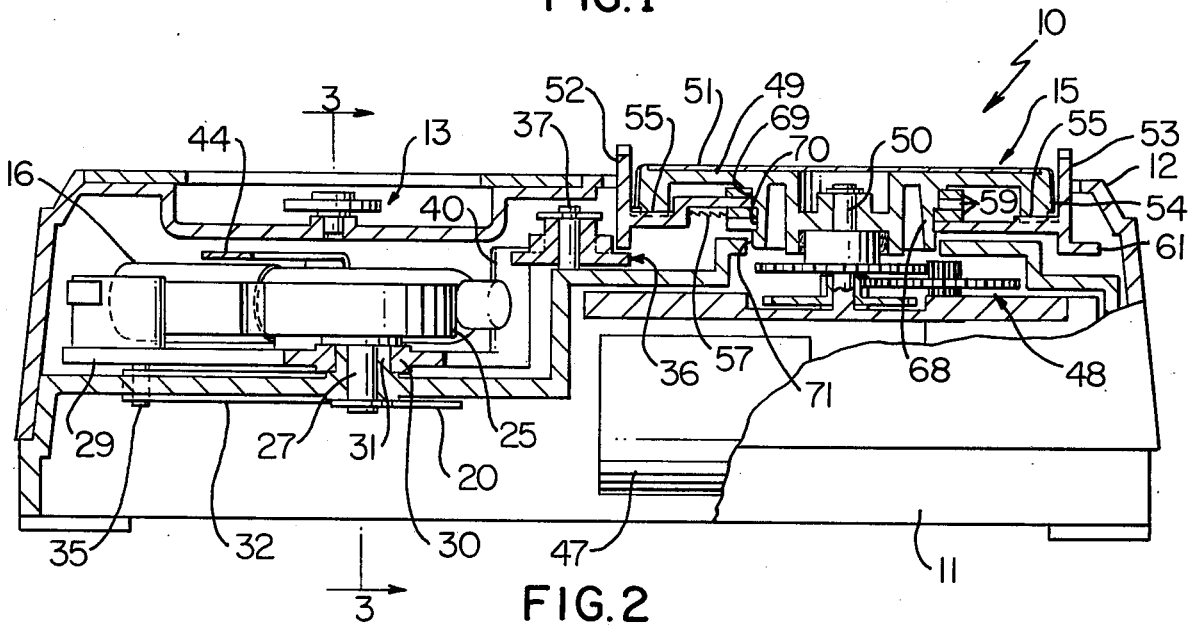
FIG. 2 is an enlarged cross-sectional view taken on line 2—2 of FIG. 1.
Figure 3:
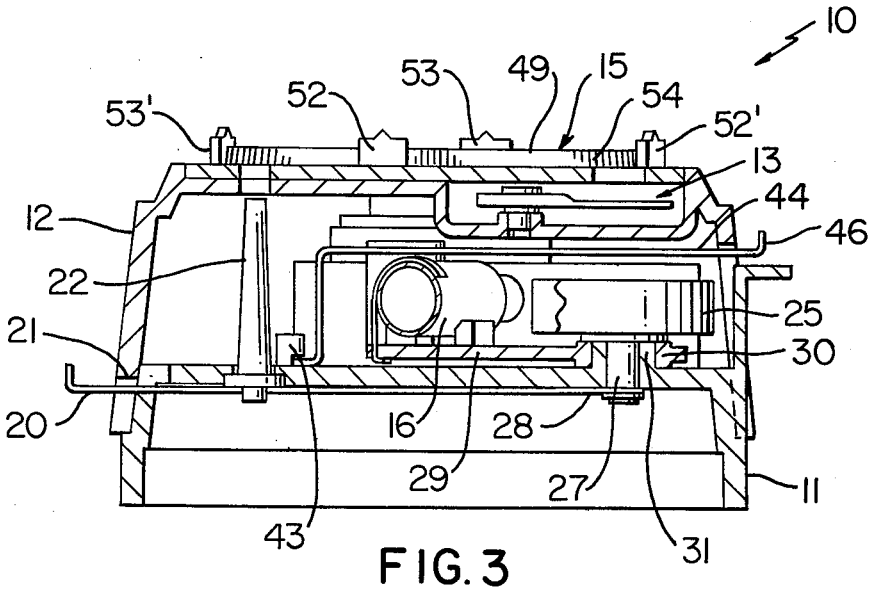
FIG. 3 is a cross-sectional view taken on line 3—3 of FIG. 2.

Referring now to FIGS. 1, 2 and 3, the improved cut-back thermostat construction of this invention is basically the same as the cut-back thermostat construction of aforementioned Ser. No. 644,599 and is generally indicated by the reference numeral 10, the construction 10 comprising a frame means or housing means 11 carrying a front cover 12 and cooperating therewith to define a temperature indicating portion 13, a temperature setting portion 14 and a timer portion 15.

Figure 4:
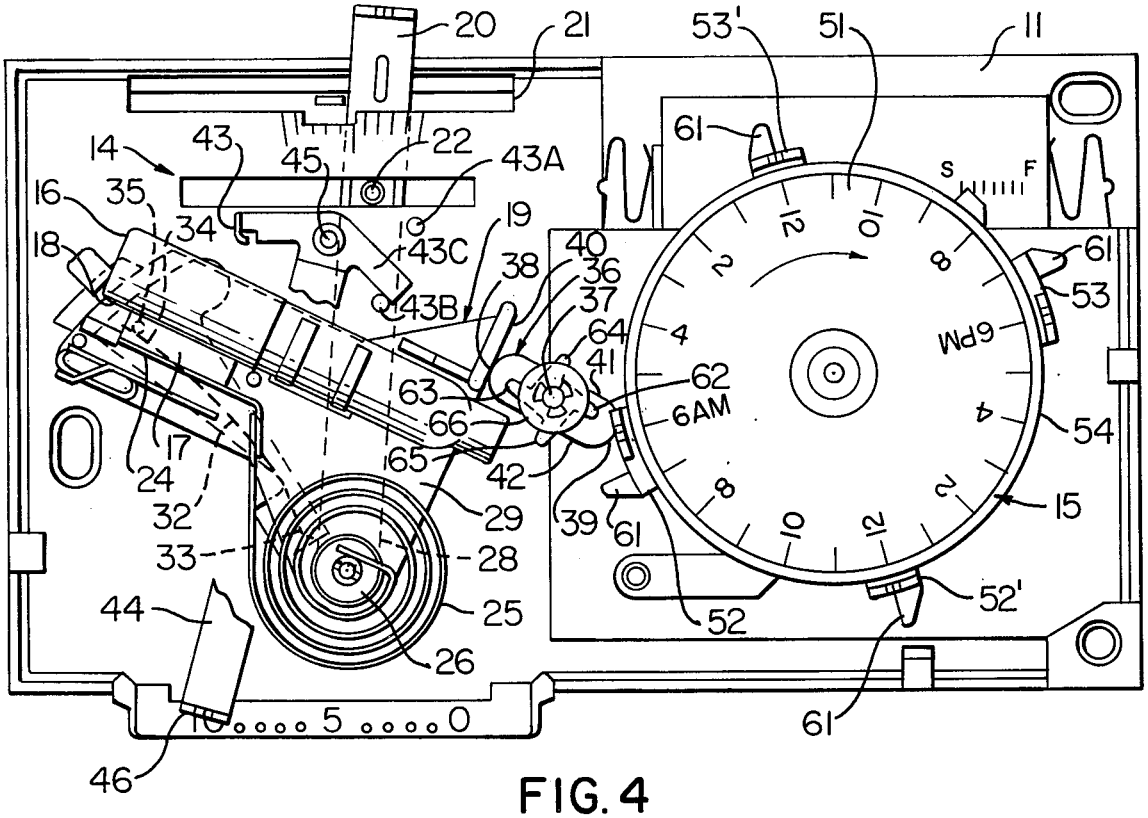
FIG. 4 is a front view of the thermostat construction of FIG. 2 with the cover removed.

As illustrated in FIG. 4, a conventional magnet armature operated electrical switch construction 16 is carried by the frame means 11 in a manner hereinafter described and is adapted to be operated to a certain condition thereof when a magnet armature or switch operator 17 is moved closely adjacent or against the outer peripheral part 18 thereof in a manner hereinafter described to turn on the heat exchange system (not shown) to tend to cause the same to have its output temperature effect increased to the temperature setting of a thermostat arrangement of the thermostat construction 10 that is generally indicated by the reference numeral 19 and which includes the switch construction 16 and magnet armature 17.

Figure 5:
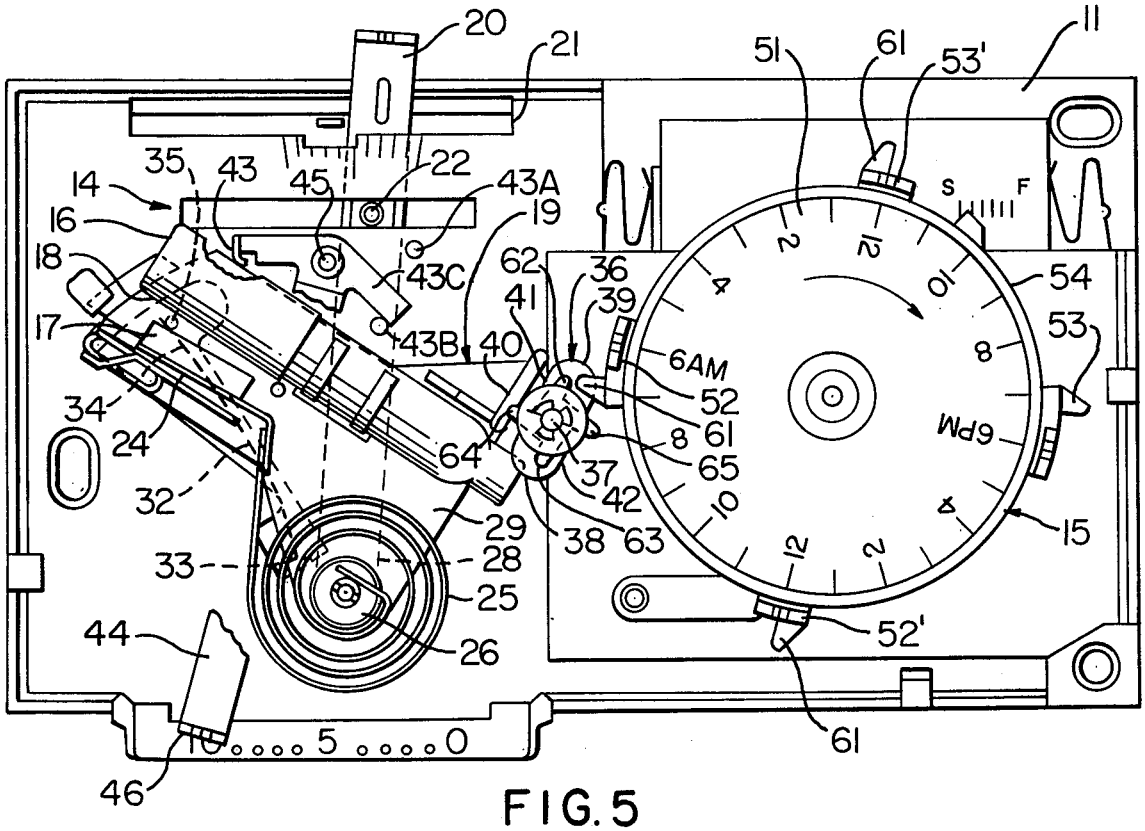
FIG. 5 is a view similar to FIG. 4 and illustrates the thermostat construction in a cut-back setting thereof.

When the magnet armature or switch operator 17 is moved away from the outer periphery 18 of the switch construction 16 a certain amount as illustrated in FIGS. 4 and 5, the switch construction 16 is operated to another condition thereof which turns off the heat exchange system.

In this manner, the thermostat construction 10 tends to maintain the output temperature effect of the heat exchange system at the temperature setting of the thermostat construction 10 as selected by a lever 20 which is movable in a slot 21 of the frame means 11 and positions an indicator post 22 thereof relative to a temperature scale 23 on the front cover 12 that forms the temperature setting portion 14 previously described.

The magnet armature 17 of the thermostat arrangement 19 is carried on the end 24 of a bimetal member 25 disposed in a spiral or coiled manner and having an inner end thereof secured to a sleeve 26 rotatably mounted to the frame means 11 by a shaft 27, FIGS. 2 and 3, adapted to be rotated by the lever 20 which has an inner end 28 fastened to the shaft 27.

In this manner, movement of the lever 20 causes rotational movement of the sleeve 26 and, thus the temperature setting of the bimetal member 25 so that different temperatures will be required to cause the armature 17 to be moved against the switch construction 16 and operate the same to a condition to cause the heat exchange system to increase its output effect as will be apparent hereinafter.

The switch construction 16 is carried by a plate 29 that is rotatably or pivotally mounted to the frame means 11 by having a portion 30 thereof rotatably disposed about a sleeve portion 31 of the frame means 11 and that is concentric with the shaft 27 for the bimetal member 25 whereby the plate 29 is rotatable relative to the frame means 11 about the same axis of rotation as the axis of rotation of the bimetal member 25 as will be apparent hereinafter.

The plate 29 is normally biased to move in a clockwise direction about its sleeve 31 in FIGS. 3 and 4 by a leaf spring 32 having one end 33 fastened to the frame means 11 and the other end 34 thereof abutting a post means 35 carried by the plate 29.

However, a rotatable and elongated actuator member 35 is rotatably carried on a post 37 of the frame means 11 and has opposed rounded ends 38 and 39 respectively adapted to engage against a flange 40 of the plate 29 in the manner illustrated in FIG. 4 to hold the plate 29 in a first rotational position relative to the frame means 11 that will provide normal day-time operation of the thermostat arrangement 19 as will be apparent hereinafter.

However, when the actuator member 36 is rotated 90°, as illustrated in FIG. 5, so that one of the narrow sides 41 and 42 thereof is facing the flange 40 of the plate 28, the force of the leaf spring 32 is adapted to cause clockwise rotation of the plate 29 relative to the frame means 11 and toward the actuator member 36 until the same abuts against a stop end 43 of a second lever 44 that is pivotally mounted to the frame means 11 by a pivot means 45. At this time, the switch construction 16 has been moved relative to the armature 17 of the bimetal member 25 and thereby requires the bimetal member 25 to only operate the switch construction 16 when the output temperature effect of the heat exchange system has fallen below the normal setting of the lever 20 a certain amount as will be apparent hereinafter.

The lever 44 has a lower end 46 that extends out of the frame means 11 to permit the user to adjust the same relative thereto and thereby select the amount of cut-back temperature that the thermostat construction 19 is to be cut back at night-time as will be apparent hereinafter.

In order to limit the movement of the adjusting lever 44 relative to the frame means 11, a pair of spaced apart stops 43A and 43B are carried by the housing means 11 and receive a tongue 43C of the adjustable lever 44 therebetween whereby the movement of the lever 44 relative to housing means in a clockwise direction in FIG. 4 is limited by the tongue 43C engaging against the stop 43B and the movement of the lever 44 in a counter clockwise direction is limited by the tongue 43C engaging the stop 43A.

The thermostat construction 11 includes an electrically operated timer motor 47 carried by the frame means 11 and which through a suitable gear train arrangement, generally indicated by the reference numeral 48 in FIG. 2, will rotate a dial member 49 relative to the frame means 11, the dial 49 being rotatably mounted to the frame means 11 about a post 50 as illustrated and indicating the time of day.

In particular, the dial 49, on the upper surface 51 thereof, has a 24 hour indication thereon so the same rotates relative to the frame means 360° every 24 hours and indicates the time of day by its location relative to a stationary indicator arrow 51' on the front cover 12 as illustrated in FIG. 1.

Figure 6:
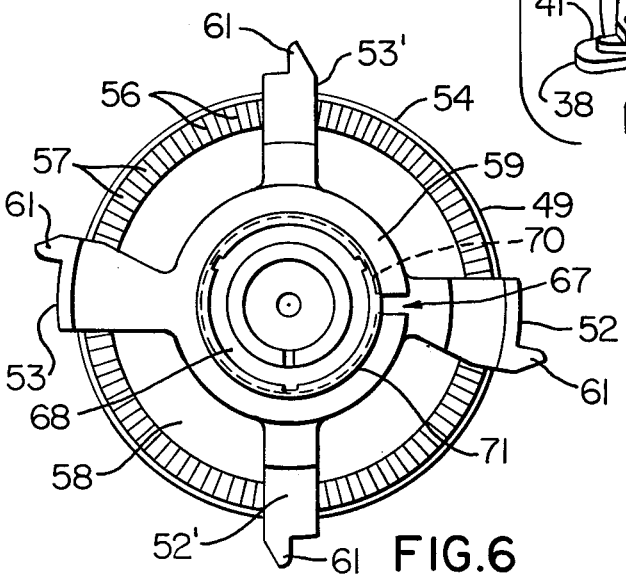
FIG. 6 is a bottom view of the timer dial assembly of the cut-back thermostat construction of FIG. 2 and is taken substantially on the line 6—6 thereof.

A plurality of adjustable tabs 52, 52', 53 and 53' are carried adjacent the outer periphery 54 of the dial member 49 and rotate in unison therewith by having abutments 55 thereof normally received in respective notches 56 between ratchet teeth 57 on the lower side 58 of the dial member 49 as illustrated in FIGS. 2 and 6, the tabs 52, 52', 53 and 53' respectively having annular or ring-like parts 59 telescoped about a cylindrical post or hub 68 of the timer dial 49 in a manner hereinafter described so that the tabs 52, 52', 53 and 53' will rotate in unison with the dial member 49 as the dial member 49 is rotatably driven by the timer motor 47.

By pushing inwardly on the respective tab 52, 52', 53 and 53' to flex the respective tab away from the dial member 49, its abutment 55 will be freed from the notches 56 of the teeth 57 of the timer dial member 49 so that the particular tab 52, 52', 53 or 53' can be manually rotated relative thereto until the particular tab 52, 52', 53 or 53' is disposed adjacent the desired time on the face 51 of the dial 49. Thereafter, the pushed inwardly tab is released and the natural resiliency thereof forces its abutment 55 into a corresponding notch 56 of the dial member 49 so that the tab 52, 52', 53 or 53' will now be set in a new position relative to the dial 49 to rotate in unison therewith until reset manually in the manner previously described.

Each tab 52, 52', 53 and 53' has an outwardly directed extension or cam part 61 with the cam parts 61 of the tabs 52 and 53 being disposed in a different plane than the cam parts 61 of the other tabs 52' and 53' so that the cams 61 of the tabs 52 and 53 are in a plane to engage only against either extension 62 or 63 of the rotatable actuator 36 as will be apparent hereinafter and the cams 61 of the tabs 52' and 53' are adapted to engage only against either extension 64 or 65 of the rotatable actuator 36 as will be apparent hereinafter.

Figure 7:
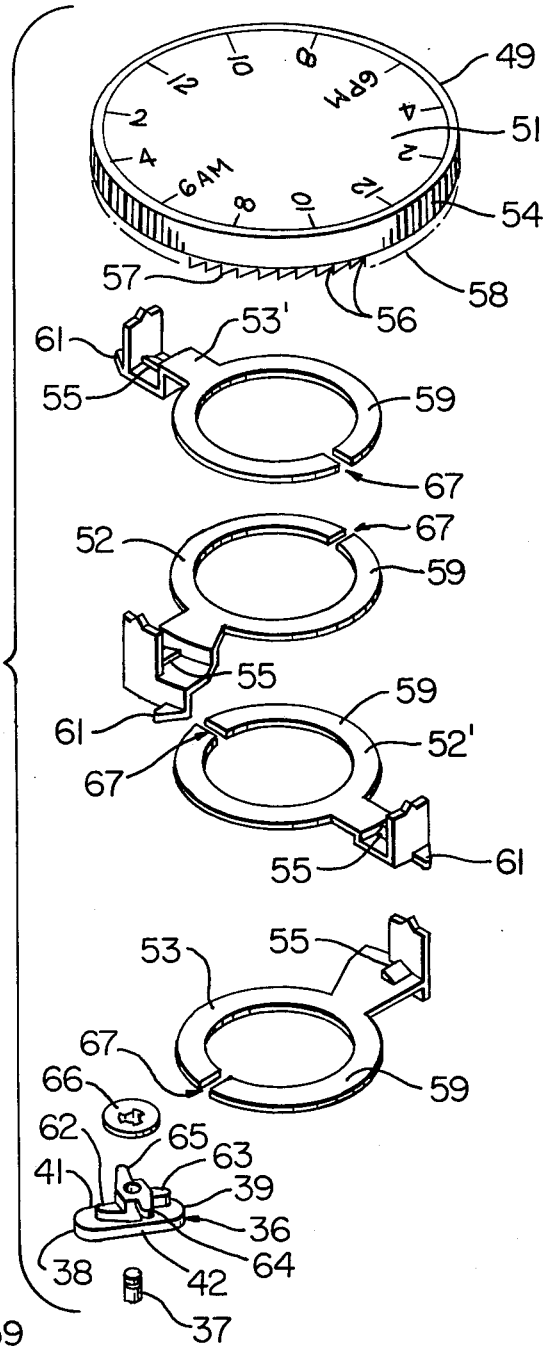
FIG. 7 is an exploded perspective view of the timer dial assembly of FIG. 6.

The ring-like portions 59 of the tabs 52, 52', 53 and 53' are split as indicated by the reference numerals 67 in FIGS. 6 and 7 in order to permit the tabs 52, 52', 53 and 53' to be readily assembled in a snap-fit manner to the cylindrical hub portion 68 that depends from the underside 58 of the timer dial 49 as illustrated in FIG. 2.

In particular, the hub 68 of the timer dial 49 has a first cylindrical portion 69 stepped from a second cylindrical portion 70 thereof, the stepped annular portion 70 comprising a recess as the hub 68 has an outer cylindrical portion 71 stepped outwardly from the annular recess 70 as illustrated.

In this manner, the ring portions 59 of the tabs 53' and 52 can be readily slipped over the larger cylindrical portion 69 of the hub 68 of the dial 49 to snap-fittingly engage against the same through the resiliency of the ring portions 59 thereof. Thereafter, the ring portions 59 of the remaining two tabs 52' and 53 can be forced over the end cylindrical portion 71 of the hub 68 of the dial member 49 to be snap-fittingly received into the annular recess 70 as illustrated in FIG. 2, whereby the tabs 52, 52', 53 and 53' are each snap-fittingly secured to the hub 68 of the dial 49 to rotate in unison therewith as long as the projections 55 thereof are disposed in the notches 56 of the teeth 57 in the manner previously described, the last two adjusting tabs 52' and 53 by being received in the recess 70 positively hold the other two tabs 53' and 52 on the larger cylindrical portion 70 of the hub 68 as is fully illustrated in FIG. 2.

Thus, it can be seen that it is a very simple assembly operation to secure the adjustable tabs 52, 52', 53 and 53' to the hub 68 of the dial member 49 to be carried therewith as a sub assembly that can be subsequently and easily fastened to the hub shaft 50 of the housing means 11 and be locked thereto by a lock washer arrangement as illustrated in FIG. 2.

The rotatable actuator 36 is held for rotational movement on the post 37 of the frame means 11 by a retaining washer 66 as illustrated.

From the above, it can be seen that the thermostat construction 10 of this invention can be made of relatively few parts to operate in a unique manner now to be described.

The operator of the thermostat construction 10 sets the tabs 52 and 53 to the desired setting relative to the dial 49 in the manner previously described when it is desired for the thermostat construction 10 to cut-back the operating temperature for the heat exchange system. In the example illustrated in the drawings, the tab 52 is set for causing temperature cut-back at 6:00 A.M. and the tab 53 is set for causing temperature cut-back at 6:00 P.M.

Similarly, the tabs 52' and 53' are set at the desired time for having the thermostat construction 10 begin to operate the heat exchange system at the desired daytime operating temperature thereof. In the example illustrated in the drawings, the tab 52' is set for causing normal operation of the heat exchange system beginning at 12:00 P.M. and the tab 53' is set for causing normal operation at 12:00 A.M.

The operator also sets the lever 20 to the desired temperature setting for normal operation, such as 70° F. and sets the lever 44 for the desired cut-back operating temperature, which may be expressed in a number of degrees below the temperature setting of the lever 20. Thus, the lever 44 may be set from anywhere between 0° and −10° below the setting of the lever 20. Accordingly, should the lever 44 be set for −10° for cut-back operation as illustrated in FIGS. 4 and 5, the thermostat construction would be set for 60° F. for the cut-back temperature in the above example.

During normal operation of the thus set thermostat construction 10, the actuator member 36 is in the first rotational position of FIG. 4 wherein either end 38 or 39 thereof is disposed against the flange 40 of the plate 29 to hold the plate 29 in the rotational position illustrated in FIG. 4 whereby the switch construction 16 is positioned closely adjacent the end 24 of the bimetal member 25 so that the bimetal member 25 will tend to maintain the heat exchange output effect at the temperature setting of the lever 20. In particular, should the output temperature effect fall below the setting of the lever 20, the bimetal member 25 moves the armature 17 against the switch construction 16 to cause the switch construction 16 to turn on the heat exchange system to increase the output temperature effect thereof. When the output temperature effect of the heat exchange system exceeds the setting of the lever 20, the bimetal member 25 moves the armature 17 away from the switch construction 16 to cause the switch construction 16 to turn off the heat exchange system.

In this manner, the heat exchange system is cycled on and off by the temperature sensing bimetal member 25 to tend to maintain the output temperature effect thereof of the heat exchange system at the temperature setting of the lever 20.

However, when the timer dial member 49 reaches the 6:00 A.M. position thereof, the tab 52 has its cam extension 61 engaged against one of the extensions 62 or 63 of the actuator member 36 and will rotate the same 90° as the timer dial member 49 continues to rotate in the manner illustrated in FIG. 5 whereby the end 38 or 39 of the actuating member 36 is moved away from the flange 40 of the plate 29 so that the force of the leaf spring 32 can now cause the plate 29 to pivot in a clockwise direction as illustrated in FIG. 5 until the same engages against the end 43 of the lever 44. Thus, if the lever 44 is set for a 10° decrease in the temperature setting of the thermostat construction 10, the plate 29 will have rotated a certain amount so that the bimetal member 25 will only cause the switch construction 16 to turn on the heat exchange system when the output temperature effect thereof has fallen to approximately 10° below the setting of the lever 20 whereby the bimetal member 25 in the new position of the switch construction 16 will tend to maintain the output temperature effect of the heat exchange system at the cut-back temperature as set by the lever 44.

Thus, the thermostat construction 10 maintains the output temperature effect of the heat exchange system at apparoximately 60° F. in the above example until 12:00 P.M. when the tab 52' of the timer dial 49 has its cam 61 engaged against one of its extensions 64 or 65 of the actuator member 36 to cause the same to rotate 90° from the position illustrated in FIG. 5 back to the position illustrated in FIG. 4. Thus, one end 39 or 38 of the rotatable actuator 36 now cams against the flange 40 of the plate 29 to rotate the plate 29 back in a counterclockwise direction to the position illustrated in FIG. 4 in opposition to the force of the leaf spring 32 whereby the thermostat arrangement 19 will now maintain the output temperature effect of the heat exchange means at the actual setting of the lever 20 as previously described until the tab 53 causes a cut-back thereof as previously described for the tab 52.

Thus, it can be seen that the tabs 52, 52', 53 and 53' of the timer dial member 49 each causes the actuator member 36 to rotate 90° when the same engage against one of its respective extensions thereof to thereby cause either a cut-back in the temperature setting of the thermostat construction 10 or a return to the normal temperature setting thereof as previously described.

Accordingly, it can be seen that the thermostat construction 10 of this invention will automatically cause the actuator member 36 to rotate 90° each time the tab 52, 52', 53 or 53' engages the same so that the actuator 36, in effect, rotates 360° every 24 hours while the timer dial 49 also rotates 360° each 24 hours.

From the above, it can be seen that the thermostat construction 10 of this invention is adapted to automatically cut back the thermostat setting of the thermostat arrangement 19 thereof from its normal setting to a cut-back setting and then automatically return the setting of the thermostat arrangement 19 back to its normal setting at predetermined times as selected by the tabs 52, 52', 53 and 53' in the manner previously described.

Thus, this invention provides an improved cut back thermostat construction and improved parts therefor.

While the form of the invention now preferred has been illustrated and described as required by the Patent Statute, it is to be understood that other forms can be utilized and still fall within the scope of the appended claims.

What is claimed is:

1. In a cut-back thermostat construction having a thermostat arrangement and a timer means carried by a housing means in such a manner that said timer means will cut-back the temperature setting of said thermostat arrangement by moving an electrical switch means of said thermostat arrangement relative to a temperature responsive switch operator of said thermostat arrangement when a predetermined time is reached by said timer means, said construction also having movable actuator means that is carried by said housing means and is operatively associated with said switch means to be adapted to cause a certain movement of said switch means relative to said switch operator when said actuator means is moved from a first position thereof to a second position thereof by said timer means when said predetermined time is reached by said timer means, said construction also having adjustable means that is carried by said housing means and is separate from said actuator means for selecting the amount of movement of said switch means relative to said switch operator when said actuator means is moved from said first position thereof to said second position thereof whereby said adjustable means selects the cut-back temperature of said thermostat arrangement, the improvement comprising stop means carried inside said housing means for limiting the degree of adjustment of said adjustable means and, thus, the amount of movement of said switch means relative to said switch operator.

2. In a cut-back thermostat construction as set forth in claim 1, biasing means interconnected to said switch means to normally tend to move said switch means to its greatest cut-back temperature position relative to said switch operator.

3. In a cut-back thermostat construction as set forth in claim 2, said actuator means being engageable with said switch means to hold said switch means in its least cut-back temperature position relative to said switch operator in opposition to the force of said biasing means when said actuator means is in said first position thereof.

4. In a cut-back thermostat construction as set forth in claim 3, said adjustable means comprising a movable member that is adapted to be positioned in the path of movement of said switch means to limit the movement of said switch means from its said least cut-back temperature position to a desired cut-back temperature position thereof.

5. In a cut-back thermostat construction as set forth in claim 4, said movable member comprising a lever pivotally mounted to said frame means and having one end thereof adapted to be positioned in said path of movement of said switch means.

6. In a cut-back thermostat construction as set forth in claim 5, said stop means being engageable with said one end of said lever to limit the position of said one end in said path of movement of said switch means.

7. In a cut-back thermostat construction as set forth in claim 6, said one end of said lever having an outwardly directed tongue, said stop means comprising a pair of spaced abutments with said tongue being disposed and movable therebetween.

8. In a cut-back thermostat construction as set forth in claim 1, said adjusting means comprising a movable member, said stop means being engageable with said movable member to limit the position of said movable member and, thus, the amount of movement of said switch means relative to said switch operator.

9. In a cut-back thermostat construction as set forth in claim 8, said adjusting means comprising a pair of spaced stops.

10. In a cut-back thermostat construction as set forth in claim 9, said movable member having a pair of tongues thereon, one of said tongues being disposed and movable between said stops and the other of said tongues being disposed and movable in the path of movement of said switch means.

11. In a thermostat construction having a thermostat arrangement and a timer means carried by a housing means in such a manner that said timer means will adjust the temperature setting of said thermostat arrangement when a predetermined time is reached by said timer means, said timer means comprising a rotatable time indicating dial carrying an adjustable tab to be set in different positions therewith for selecting a desired predetermined time for adjusting said thermostat arrangement, the improvement wherein said adjustable tab is snap-fitted to said dial.

12. In a thermostat construction as set forth in claim 11, said dial having a hub portion, said tab being snap-fitted to said hub portion of said dial.

13. In a thermostat construction as set forth in claim 12, said tab having a ring portion telescopically receiving said hub portion, said ring portion being split to provide for said snap-fit relation.

14. In a thermostat construction as set forth in claim 13, said hub portion having an annular recess therein, said tab having said split ring portion snap-fitted into said annular recess.

15. In a thermostat construction as set forth in claim 11, another adjustable tab being snap-fitted to said dial.

16. In a timer dial for a thermostat construction having a thermostat arrangement and a timer means carried by a housing means in such a manner that said timer means will adjust the temperature setting of said thermostat arrangement when a predetermined time is reached by said timer means, said time indicating dial carrying an adjustable tab to be set in different positions therewith for selecting a desired predetermined time for said timer means to adjust said thermostat arrangement, the improvement wherein said adjustable tab is snap-fitted to said dial.

17. In a timer dial as set forth in claim 16, said dial having a hub portion, said tab being snap-fitted to said hub portion of said dial.

18. In a timer dial as set forth in claim 17, said tab having a ring portion telescopically receiving said hub portion, said ring portion being split to provide for said snap-fit relation.

19. In a timer dial as set forth in claim 18, said hub portion having an annular recess therein, said tab having said split ring portion snap-fitted into said annular recess.

20. In a timer dial as set forth in claim 16, another adjustable tab being snap-fitted to said dial.

* * * * *